US009500429B2

(12) United States Patent
Brooker et al.

(10) Patent No.: US 9,500,429 B2
(45) Date of Patent: Nov. 22, 2016

(54) UNIFIED BOLT AND BOLT CARRIER CLEANING TOOL

(71) Applicant: The Otis Patent Trust, Lyons Falls, NY (US)

(72) Inventors: James R. Brooker, Constantia, NY (US); Christopher Ashley, Ithaca, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 0 days.

(21) Appl. No.: 13/797,253

(22) Filed: Mar. 12, 2013

(65) Prior Publication Data

US 2014/0158162 A1 Jun. 12, 2014

Related U.S. Application Data

(60) Provisional application No. 61/734,759, filed on Dec. 7, 2012.

(51) Int. Cl.
*F41A 29/02* (2006.01)

(52) U.S. Cl.
CPC ..... *F41A 29/02* (2013.01)

(58) Field of Classification Search
None
See application file for complete search history.

(56) References Cited

U.S. PATENT DOCUMENTS 4,899,415 A * 2/1990 Wheeler ..... F41A 29/02 15/104.05
6,206,620 B1 * 3/2001 Burns ..... B23G 5/04 408/215
2009/0178324 A1 * 7/2009 Hopper et al. ..... 42/90
2010/0186769 A1 * 7/2010 Jaquish ..... B08B 1/00 134/6
2010/0325933 A1 * 12/2010 Huang ..... 42/90
2011/0113669 A1 * 5/2011 Oselinsky et al. ..... 42/90
2012/0186127 A1 * 7/2012 Shipman ..... F41A 29/02 42/95
2013/0047483 A1 * 2/2013 Horne ..... 42/90

OTHER PUBLICATIONS http://www.youtube.com/watch?v=akh1pFpBReg; Otis Technologylnc; Oct. 22, 2012.*
European Patent Office, Extended European Search Report for Corresponding European Application No. EP13194768.1 dated Jun. 22, 2016 (6 pgs).

* cited by examiner

*Primary Examiner* — Nicole Blan
*Assistant Examiner* — Pradhuman Parihar
(74) *Attorney, Agent, or Firm* — Harris Beach PLLC

(57) ABSTRACT

A unified bolt and bolt carrier cleaning tool comprising a cylindrical body having a bolt scraper arrangement formed at a first end and a bolt carrier scraper arrangement formed at an opposite end. The bolt scraper arrangement includes a well having two scraper blades shaped to conform to the outer surfaces of the bolt face of a bolt assembly of a weapon. The bolt carrier scraper arrangement includes three longitudinal scraper blades formed in the outer surface and end of the body, the blades being shaped to conform to an inner surface of a bolt-receiving chamber of the bolt carrier. Preferably the tool further comprises a first transverse bore threaded for receiving an auxiliary cleaning tool. Preferably, the tool further comprises a second transverse bore and associated circular recess having scraper blades for cleaning the surfaces of a firing pin extracted from the bolt.

7 Claims, 10 Drawing Sheets

UNIFIED BOLT AND BOLT CARRIER CLEANING TOOL

The present application draws priority from a provisional U.S. Provisional patent application, Ser. No. 61/734,759, filed Dec. 7, 2012. The present application also incorporates by reference in its entirety US Patent Application Publication No. US 2012/0186127, which is owned by the common assignee of this application.

FIELD OF THE INVENTION

The present disclosure relates generally to a system and tools for cleaning firearm components, including a bolt and bolt carrier, for firearms such as an M4, M16, AR15 and other rifles and carbines, for example; more particularly to a single cleaning tool adapted to scrape deposits from the surfaces of a bolt, a bolt carrier and firing pin of a such a firearm.

BACKGROUND OF THE INVENTION

Carbon and other residue from gunpowder and from firearm discharge reactions accumulate on firearm components over time, with deleterious effects on cleanliness, performance, and longevity of the firearm. Firearm discharge residue accumulates on various firearm components that require disassembly of the firearm and subassemblies to access and clean the firearm. Even then, carbon and other discharge residue tend to be tenacious and difficult to remove. Some firearm components typically need to be scraped with a hard scraping tool to have discharge residue effectively removed, but this must be done without scratching or damaging the firearm components themselves. Various firearm components also have complex shapes that make cleaning discharge residue a challenge. For example, the bolt and bolt carrier of a 5.56 or 7.62 cartridge M4, M16 or AR15 sytle rifles have complicated shapes, such as the concave shape of the nose of the bolt, the complementary housing of the bolt carrier and the external surface of the elongated firing pin that have proven to be persistently difficult to clean effectively. A number of specialized scraping tools have been introduced to clean firearm components, but have had substantial shortcomings. See, for example, US Patent Application Publication No. US 2012/0186127, which is incorporated by reference in its entirety.

Although prior art bolt scraping tools can be useful and may be advantageous for certain applications, they suffer from drawbacks. One significant drawback is that a prior art bolt scraping tool may be adapted for scraping only the outer surface of a weapon bolt, whereas the bolt carrier into which the bolt slides can also benefit from a scraper contoured to fit the inner surfaces of the bolt carrier. The incorporated reference discloses both a bolt scraping tool and a bolt carrier scraping tool, as two separate tools.

An improvement in the scraper art is a unified cleaning tool adapted to scrape the outer surfaces of a bolt, the inner surfaces of a bolt carrier and the outer surface of a firing pin of such a firearm.

SUMMARY OF THE INVENTION

Briefly described, a unified bolt and bolt carrier cleaning tool in accordance with the present invention comprises a generally cylindrical body having a female bolt scraper arrangement formed at a first end thereof and a male bolt carrier scraper arrangement formed at an opposite end thereof. The female bolt scraper arrangement includes an axial well having at least one scraping blade, and preferably two, formed in a wall thereof, the blade being shaped to conform to the outer surfaces of the bolt face of a bolt assembly of a weapon such as an M4, M16 or AR15 style rifle. The male bolt carrier scraper arrangement includes at least one longitudinal scraping blade, and preferably three arranged symmetrically, formed in the outer surface and end of the cylindrical body, the blade being shaped to conform to an inner surface of a bolt-receiving chamber of the bolt carrier. Preferably, a unified cleaning tool in accordance with the present invention further comprises a transverse threaded bore in the cylindrical tool body for receiving any of various auxiliary tool elements such as a wire brush attachment for assisting in cleaning the bolt-receiving and/or firing chamber of a weapon. In such application, the tool body simply functions as a T-handle for the auxiliary tool element. Preferably, such a tool further comprises a second transverse bore and associated circular recess having at least one scraper blade for cleaning the surface of a firing pin extracted from the bolt.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
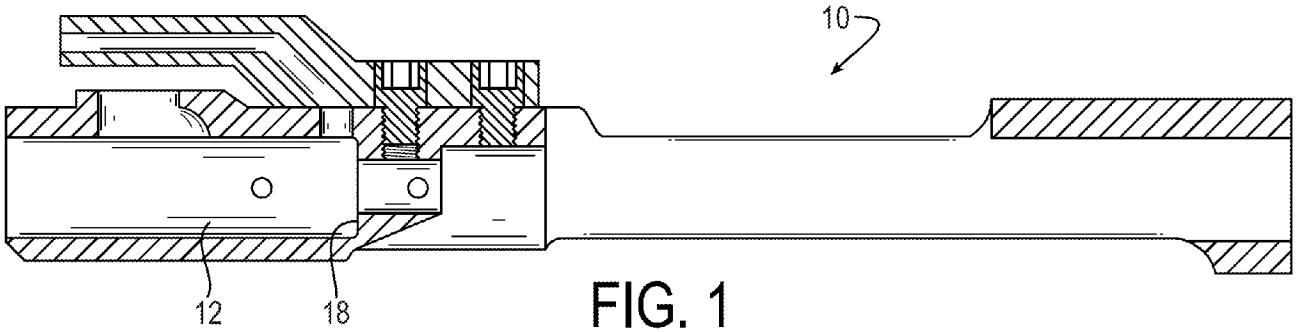
FIG. 1 (PRIOR ART)
FIG. 1 is an elevational cross-sectional view of a prior art bolt carrier of a firearm.
Figure 2:
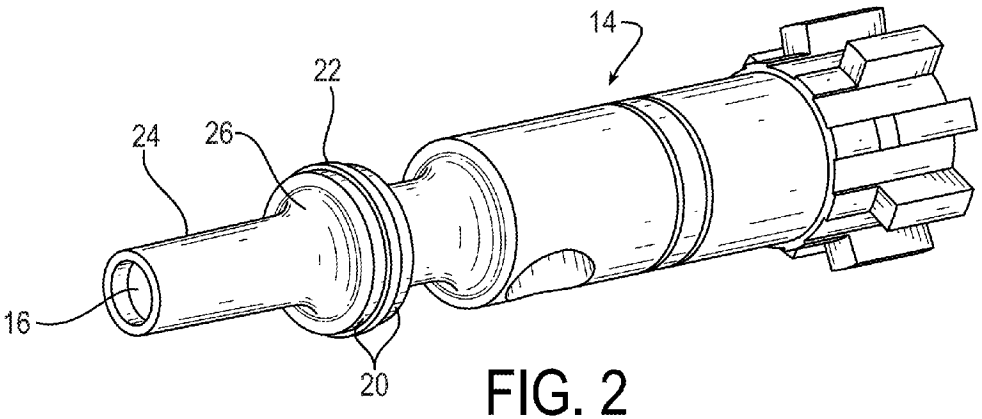
FIG. 2 (PRIOR ART)
FIG. 2 is an isometric view of a prior art bolt sub-assembly of the firearm components shown in FIG. 1.
Figure 2A:
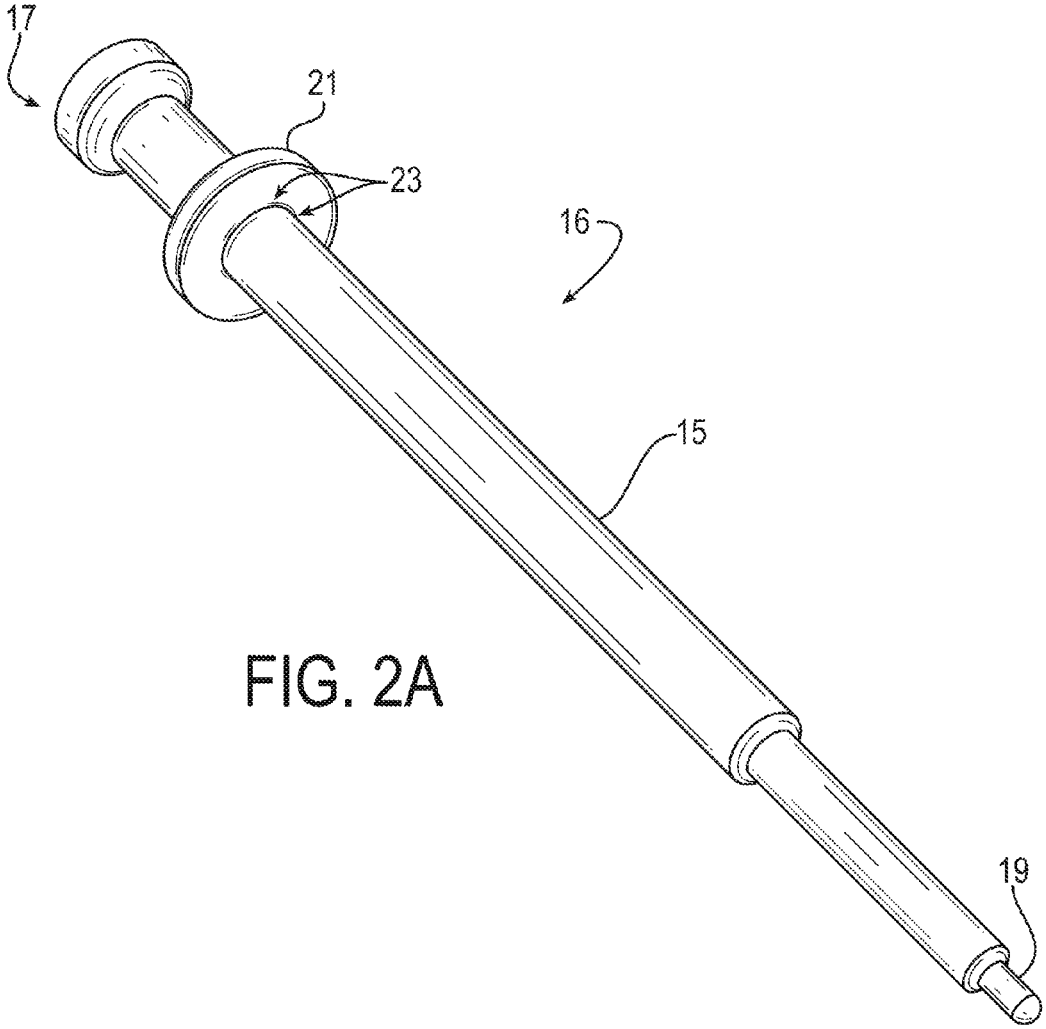
FIG. 2A is an perspective view of a prior art firing pin of the bolt sub-assembly of the weapon shown in FIG. 2.
Figure 3:
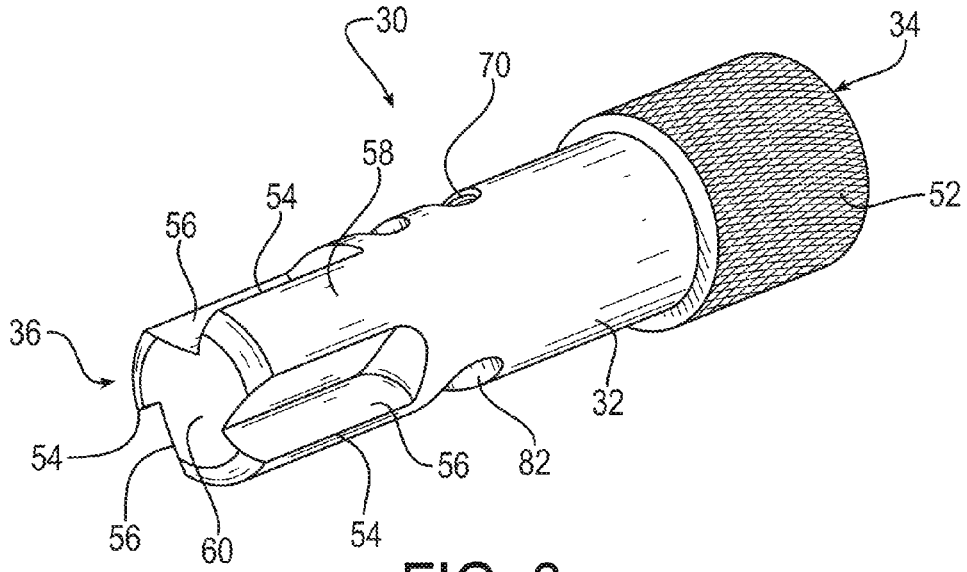
FIG. 3 is an isometric view of a unified bolt and bolt carrier cleaning tool in accordance with the present invention.
Figure 4:
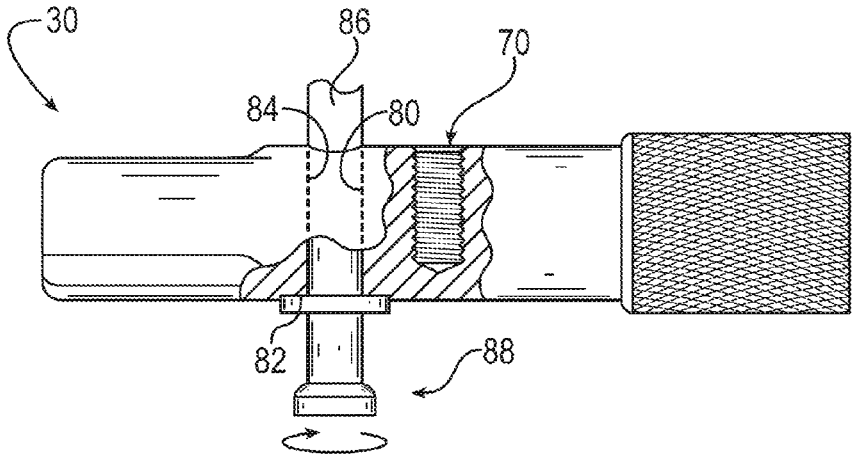
FIG. 4 is an elevational view of the unified bolt and bolt carrier cleaning tool shown in FIG. 3 showing a rifle firing pin being cleaned in a pin-cleaning arrangement.
Figure 5:
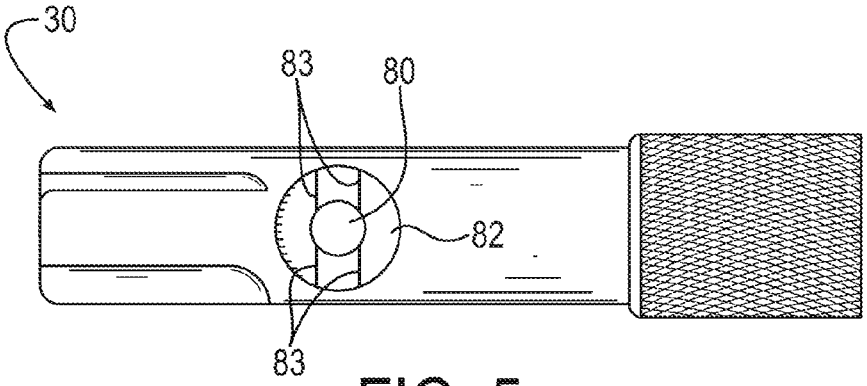
FIG. 5 is an elevational view of the unified bolt and bolt carrier cleaning tool shown in FIG. 4, taken after 90° of rotation about a longitudinal axis.
Figure 6:
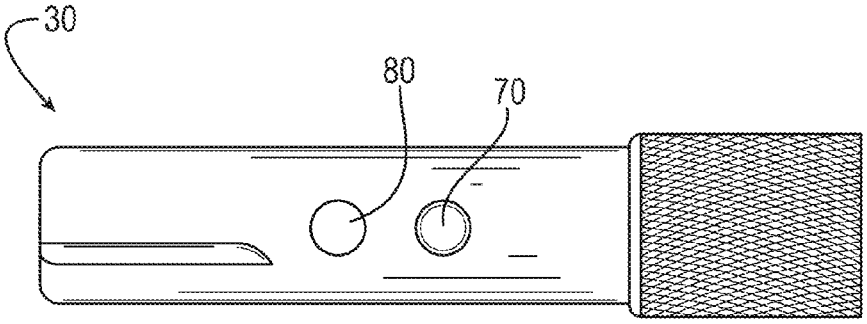
FIG. 6 is an elevational view of the unified bolt and bolt carrier cleaning tool shown in FIG. 4, taken after an additional 180° of rotation about a longitudinal axis.
Figure 7:
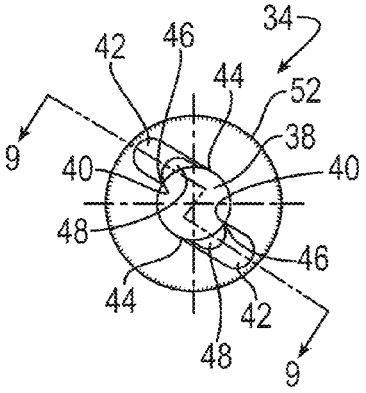
FIG. 7 is an end view of a first embodiment a bolt-cleaning arrangement of the unified bolt and bolt carrier cleaning tool shown in FIG. 3.
Figure 8:
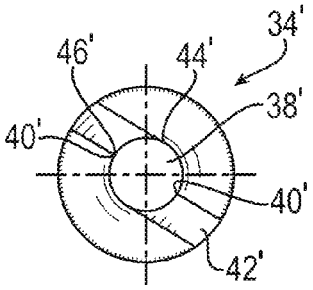
FIG. 8 is an end view of a second embodiment a bolt-cleaning arrangement of the unified bolt and bolt carrier cleaning tool shown in FIG. 3.
Figure 9:
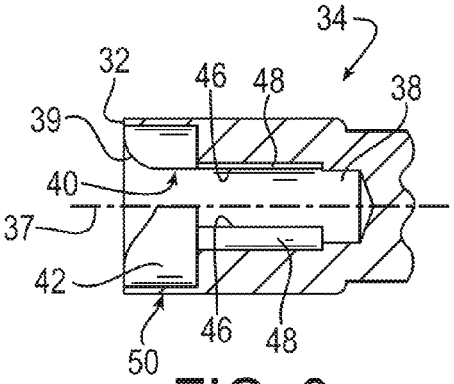
FIG. 9 is a sectional view taken along line 9-9 through the bolt-cleaning arrangement shown in FIG. 7.
Figure 10:
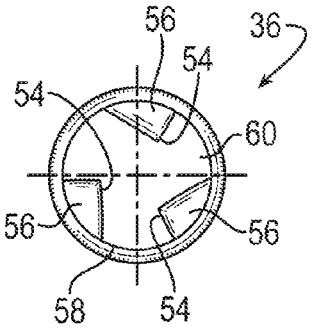
FIG. 10 is an end view of a bolt carrier cleaning arrangement of the unified bolt and bolt carrier cleaning tool shown in FIG. 3.

Referring to FIGS. 1, 2 and 2A, a bolt carrier 10 for a weapon such as an M4, M16 or AR15 style rifle includes a chamber 12 for slidably receiving a bolt assembly 14 having a firing pin 16. Chamber 12 may have a relatively internal seating wall 18 at an intermediate portion of the bolt receiving cavity of the bolt carrier.

Bolt assembly 14 comprises an outer surface including a gas ring surface 20 that serves as a gas sealing ring holding section of bolt assembly 14. A gas sealing ring 22 is typically disposed in annular depression in gas ring surface 20. The outer surface further comprises a bolt cylindrical section 24 and a curved bolt face 26.

Firing pin 16, depicted in FIG. 2A, has an elongated body 15, a first end having an end flange 17 and a second end 19. Between the first and second ends, the firing pin has an intermediate flange 21. The portion 23 of the firing pin where the elongated body joins the intermediate flange toward the second end of the firing pin, is prone to accumulations of discharge residue and is difficult to clean due to the complex shape of the firing pin.

Chamber 12, including seating wall 18, and also cylindrical section 24, and curved bolt face 26 are prone to collecting byproducts of ammunition being fired, which can interfere with further operation of the weapon and periodically require cleaning as by scraping and brushing.

It is an important object of the present invention to provide a unified bolt and bolt carrier cleaning tool comprising at least a carrier chamber scraper arrangement and a bolt scraper arrangement in a single tool. It is another object of the invention to provide an additional scraping tool to clean a portion of a firing pin of an associated firearm.

Referring now to FIGS. 3 through 10, a unified bolt and bolt carrier cleaning tool 30 in accordance with the present invention comprises a generally cylindrical, elongated body 32, formed preferably of a durable metal such as stainless steel, having a female bolt scraper arrangement 34 formed at a first end thereof and a male bolt receiver scraper arrangement 36 formed at an opposite end thereof.

A first embodiment 34 of a bolt scraper arrangement includes an axial bore including a cylindrical wall section 38, a curved wall section 39, and having at least one scraping blade 40, and preferably two, formed in a wall thereof, the blade being shaped to conform to the outer surfaces of the cylindrical and curved bolt faces 24, 26 and the gas ring 22 of bolt assembly 14. Blades 40 are the result of forming first axial recesses 42 offset from the longitudinal axis 37 of the bore and intersecting cylindrical wall section 38 tangentially at first recess edges 44 and normally at second recess edges 46; and second axial recesses 48 also beside and intersecting cylindrical wall section 38 along the same longitudinal lines as second recess edges 46, creating sharp first and second scraping blades 40. In end portion 50 of body 32, blades 40 are progressively flared through the curved wall section 39 from cylindrical wall section 38 to the end of body 32, conforming to the cylindrical and curved sections of the bolt face 26. Preferably, body 32 has an increased diameter and is knurled 52 (as shown) or axially or radially grooved (not shown) on a portion of the outer surface of bolt scraper arrangement 34 to provide a firm grip for manual rotation of tool 30 by a user.

An alternative embodiment 34' of a bolt scraper arrangement includes a cylindrical axial well 38' having at least one scraping blade 40', and preferably two, formed in a wall thereof, the blade being shaped to conform to the outer surfaces of the cylindrical and curved bolt faces 24, 26 and the gas ring 22 of bolt assembly 14. Blades 40' are the result of forming first axial recesses 42' beside and intersecting cylindrical well 38' tangentially at first recess edges 44' and normally at second recess edges 46'. In this embodiment, first axial recesses 42' are simply slots that extend through outer surface of the body adjacent to the knurled or grooved surface 52. As in first embodiment 34, second axial recesses 48' also interrupt cylindrical well 38' along the same longitudinal lines as second recess edges 46', creating sharp first and second scraping blades 40'. In this alternative embodiment, the internal axial bore of the first end is not continuous as it is interrupted by the slots. Blades 40' are progressively flared from well 38' to the end of body 32, conformal with bolt surface 26.

Bolt carrier scraper arrangement 36 includes at least one longitudinal scraping blade 54, and preferably three arranged symmetrically, formed by longitudinal incising 56 of outer surface 58 and end 60 of cylindrical body 32, blade 54 being shaped to conform to the inner surface of the bolt carrier chamber 12 and end wall 18. Preferably, the transition region 62 between cylinder surface 58 and end surface 60 is beveled or curved to mate with a similar transition at the end of bolt carrier chamber 12.

Figure 11:
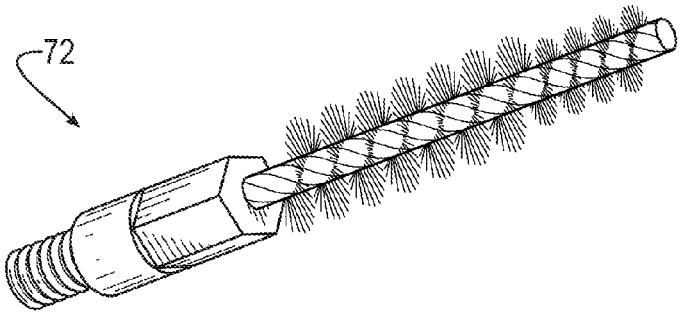
FIG. 11 (PRIOR ART)
FIG. 11 is an isometric view of an exemplary auxiliary tool for use with a unified bolt and bolt carrier cleaning tool in accordance with the present invention, e.g., a prior art bolt carrier cleaning brush.

Preferably, a unified cleaning tool 30 in accordance with the present invention further comprises a first transverse threaded bore 70 in cylindrical tool body 32 for receiving any of various auxiliary tool elements such as a wire brush attachment 72 (FIG. 11) for cleaning the firing chamber of a weapon. First bore 70 preferably is a blind bore and does not extend all the way through tool body 32. In such application, tool body 32 simply functions as a T-handle for the auxiliary tool element.

Preferably, a unified cleaning tool in accordance with the present invention further comprises a second transverse bore 80 and associated circular recess 82. Bore 80 includes at least one scraper blade 84 for cleaning the shaft 86 of a firing pin 16, 88 extracted from bolt 14. Circular recess 82 is provided with at least one scraper blade 83, and preferably four, for cleaning the surface of flange 90 on firing pin 16, 88 when the firing pin is rotated in second bore 80 by a user.

Figure 12:
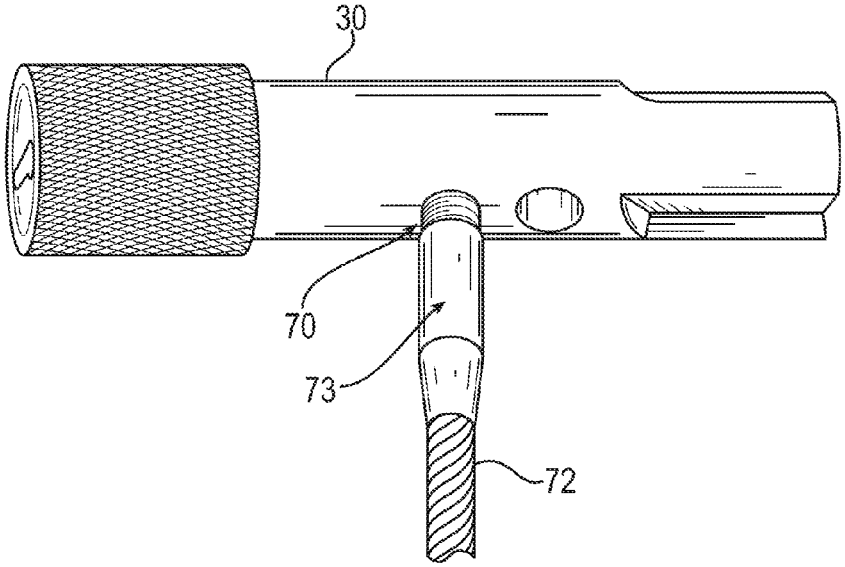
FIG. 12 is a perspective view of an exemplary auxiliary tool in threaded engagement with the transverse bore such that an exemplary embodiment of the bolt scraping tool of the invention acts as a T-handle for manipulation of the auxiliary tool.

Use of the exemplary embodiments of the invention is described in FIGS. 12 through 18. In FIG. 12, the threaded fitting 73 of an auxiliary tool 72 is threadedly engaged with the threaded transverse bore 70 of tool 30. The outer portion of the bolt receiving cavity of the bolt carrier may be cleaned by attaching a bore brush having bristles arranged on the brush having slightly larger than the diameter of the bolt receiving cavity, inserting the bore brush into the bolt receiving cavity and rotating the bore brush within the cavity utilizing the tool 30 as a T-handle for the brush.

Figure 13:
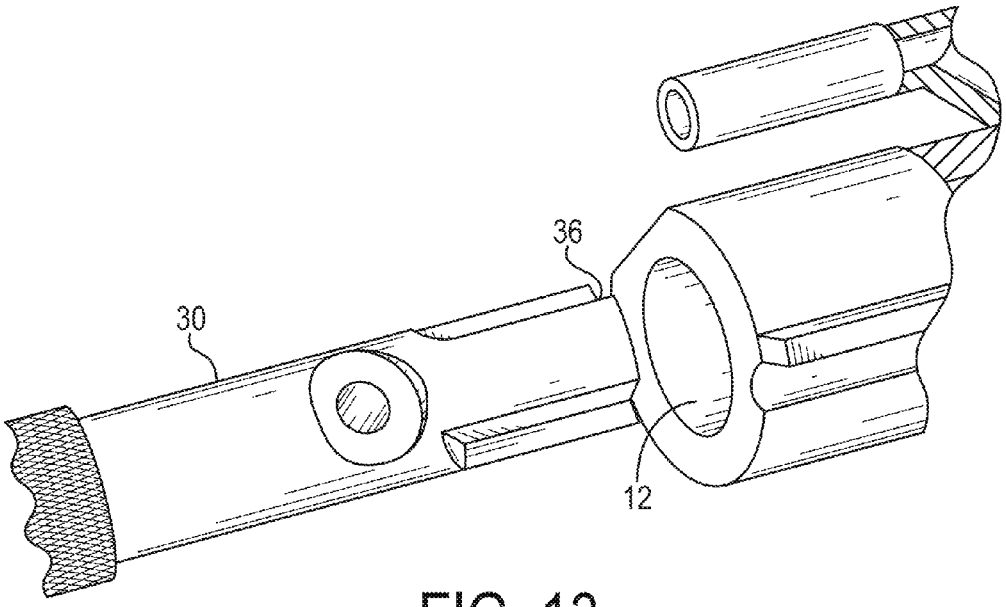
FIG. 13 is a perspective view of the male end of an exemplary embodiment of the bolt scraping tool of the invention positioned for insertion into the bolt carrier of a firearm.
Figure 14:
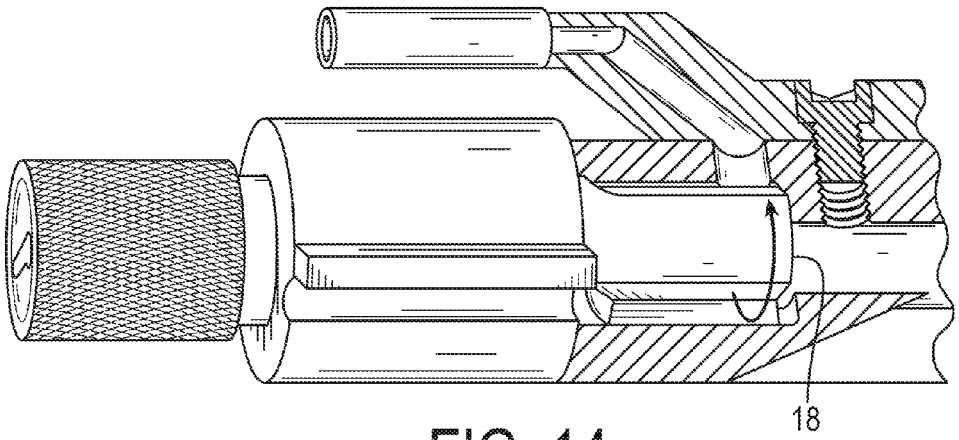
FIG. 14 is a cut-away perspective view of an exemplary embodiment of the bolt scraping tool of the invention deployed within the bolt receiving cavity of the bolt carrier and engaged in scraping engagement with an internal surface of the bolt carrier.

The bolt receiving cavity 12 may be further cleaned by inserting the end 36 of the tool having the male scraper arrangement into the bolt receiving cavity 12 as shown in FIGS. 13 and 14. When the male end of the scraper touches the seating wall 18 of the bolt receiving cavity, the tool 30 is rotated in the direction of the arrow on FIG. 14 to engage the edges 54 to remove accumulated discharge residue from the seating wall 18 and the internal wall of the bolt receiving cavity.

Figure 15:
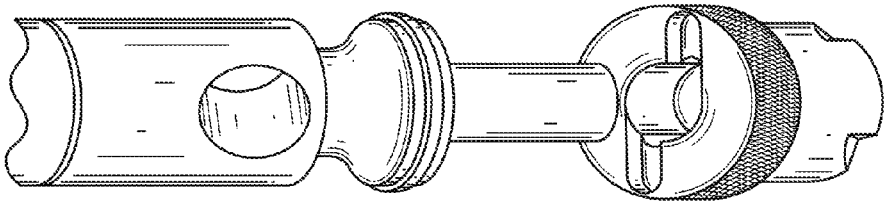
FIG. 15 is a perspective view of the convex tip of the bolt of a firearm position for insertion into the female end of an exemplary embodiment of the bolt scraping tool of the invention.
Figure 16:
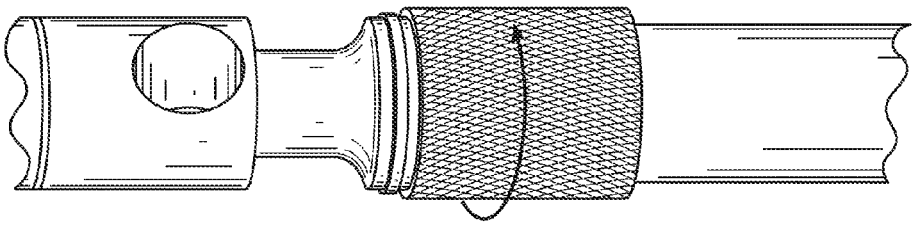
FIG. 16 is a perspective view of the bolt of a firearm inserted into scraping engagement with the female end of an exemplary embodiment of the bolt scraping tool of the invention.

With respect to FIGS. 15 and 16, the cylindrical section 24 and curved section 26 of the bolt face are cleaned by insertion of the bolt face into the axial bore 38. Upon full insertion of the bolt assembly 14 into the axial cavity, the tool 30 and bolt assembly 14 are rotated relative to each other in the direction of the arrow depicted in FIG. 16 to engage the scraper blades against the cylindrical section 24 and curved section 26 of the bolt face to scrape away accumulated deposits of discharge residue.

Figure 17:
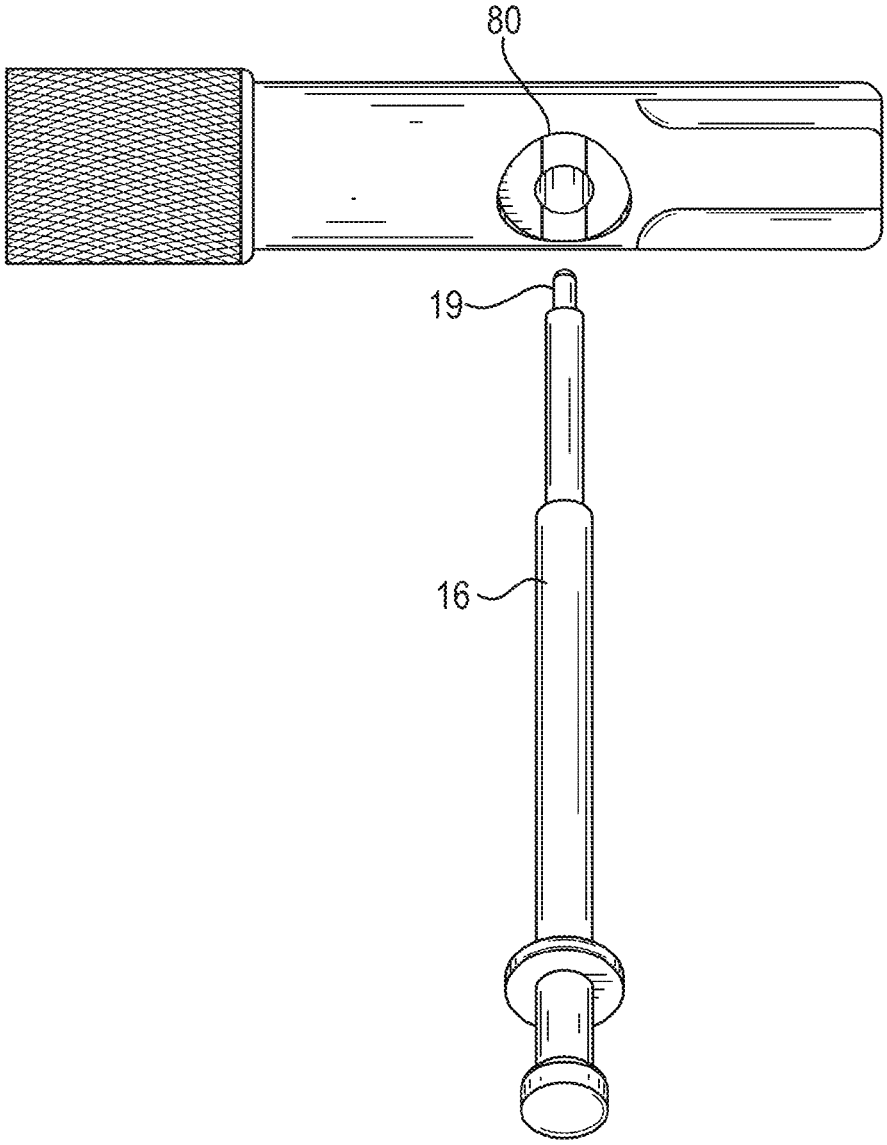
FIG. 17 is a perspective view of a firing pin of a firearm positioned for insertion into a transverse bore of an exemplary embodiment of the bolt scraping tool of the invention.
Figure 18:
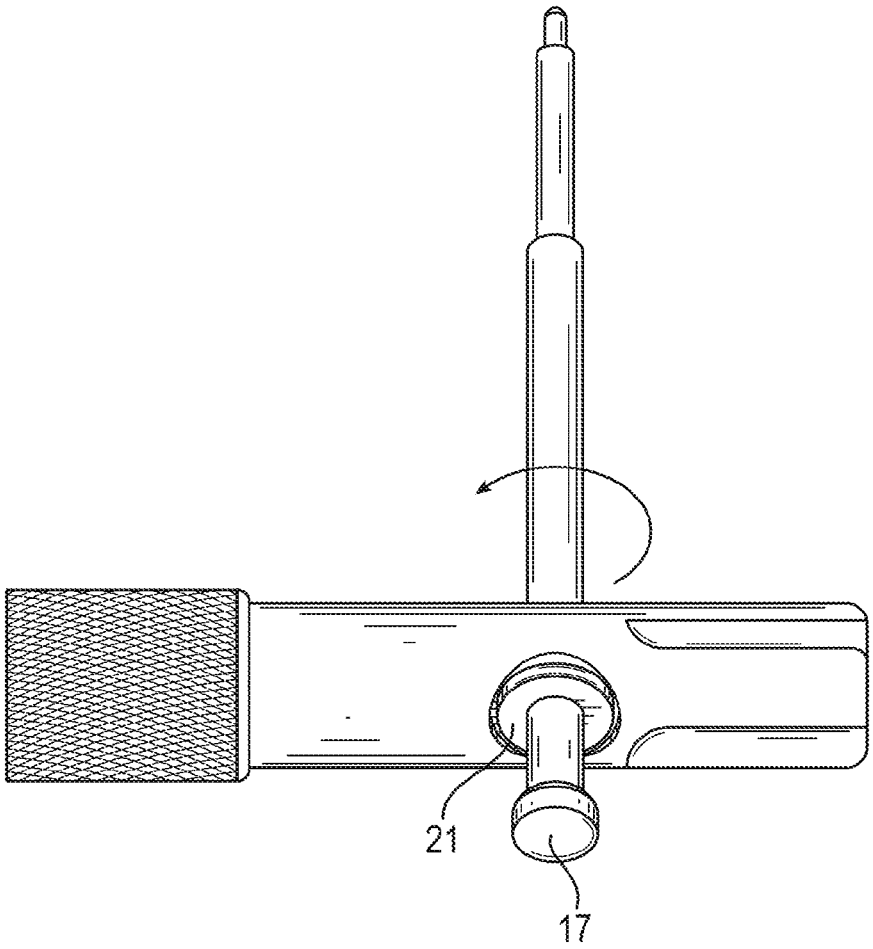
FIG. 18 is a perspective view of a firing pin inserted into scraping engagement with the scraping blade in a transverse bore of an exemplary embodiment of the bolt scraping tool of the invention.

With respect to FIGS. 17 and 18, the second end 19 of firing pin 16 is inserted into the transverse bore 80 from the end of the bore having circular recess 82. The pin is inserted until the face of the intermediate flange 21 abuts the circular recess 82. The firing pin and the tool are rotated relative to each other, for example, in the direction of the arrow on FIG. 18 to engage the scraper blades 83 with the region 23 of the pin including the joint between the elongated body 15 of the pin and the flange 21.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A gun cleaning tool for cleaning components of bolt carrier group of a firearm, the bolt carrier group including a rifle bolt having a rifle bolt face comprising a cylindrical section and a curved section, a bolt carrier defining a bolt-receiving chamber, and a firing pin, said gun cleaning tool comprising:

an elongated body having a first end, a second end, and a longitudinal axis, said first end comprising:

a cylindrical body having a knurled or grooved cylindrical portion of an outer surface of said cylindrical body adapted to provide a firm grip for manual rotation of said cylindrical body by a user;

a curved wall section extending in a direction of said longitudinal axis into an interior cylindrical wall section, said curved wall section conforming to the curved section of the rifle bolt, and said interior cylindrical wall section defining an access to conform to and to support the cylindrical section of the rifle bolt;

at least two first axial recesses creating first U shaped openings extending substantially parallel to said longitudinal axis into said cylindrical body, said at least two first axial recesses providing at least two open spaces between said interior cylindrical wall section and said outer surface of said cylindrical body which remain open when the cylindrical section of the rifle bolt is seated in the interior cylindrical wall section and the curved section of the rifle bolt is seated against the curved wall section, each of said at least two first axial recesses defining a first U shape center line perpendicular to said longitudinal axis, each of said at least two axial recesses disposed radially around said interior cylindrical wall section such that each of said first U shape center lines is different and no two axial recesses directly face each other oppositely along a common first U shape center line;

at least two second axial recesses creating second U shaped openings extending substantially parallel to said longitudinal axis into said cylindrical body, said second U shaped openings extending along said portion of said interior wall which scrapes the cylindrical section of the rifle bolt, said second U shaped openings smaller than said first U shaped openings;

at least two scraping blades defined by at least one edge of each of said at least two axial recesses, said at least two scraping blades shaped to conform to the outer surfaces of the cylindrical and curved rifle bolt faces to scrape away accumulated deposits of discharge residue; and said second end comprising a plurality of scraper blades formed in the outer surface and second end, said blades being shaped to conform to an inner surface of the bolt-receiving chamber of a bolt carrier.

2. A gun cleaning tool in accordance with claim 1 further comprising a transverse bore through said gun cleaning tool and a circular recess about an end of said transverse bore, said transverse bore including a scraper blade for cleaning a portion of a firing pin.

3. A gun cleaning tool in accordance with claim 2, wherein said scraper blade in said transverse bore further comprises a circular recess to scrape the portion of the firing pin adjacent to a flange on said firing pin.

4. A gun cleaning tool in accordance with claim 1 wherein the plurality of scraping blades at the second end of the gun cleaning tool comprises three bolt scraper blades.

5. A gun cleaning tool in accordance with claim 4 wherein said three scraper blades are symmetrically arranged about a central axis.

6. A gun cleaning tool in accordance with claim 1 further comprising a threaded transverse bore for receiving an auxiliary tool element.

7. A gun cleaning tool in accordance with claim 1 wherein said scraper blade formed in the interior surface of said cylindrical body is defined by said first axial recess intersecting an axial bore tangentially at a first recess edge and normally at a second recess edge.

* * * * *